US012185811B2

(12) United States Patent
Chen et al.

(10) Patent No.: US 12,185,811 B2
(45) Date of Patent: Jan. 7, 2025

(54) HANHELD ELECTRIC HAIR DRYER

(71) Applicant: Guangzhou Ousheng Trade Co., Ltd, Gugangzhou (CN)

(72) Inventors: Liquan Chen, Gugangzhou (CN); Weidong Zhang, Gugangzhou (CN)

(73) Assignee: Guangzhou Ousheng Trade Co., Ltd, Guangzhou (CN)

( * ) Notice: Subject to any disclaimer, the term of this patent is extended or adjusted under 35 U.S.C. 154(b) by 680 days.

(21) Appl. No.: 17/408,879

(22) Filed: Aug. 23, 2021

(65) Prior Publication Data

US 2022/0087392 A1 Mar. 24, 2022

(30) Foreign Application Priority Data

Sep. 23, 2020 (CN) ..... 202011008242.7
Sep. 23, 2020 (CN) ..... 202011008298.2
Sep. 23, 2020 (CN) ..... 202011010666.7
Sep. 23, 2020 (CN) ..... 202011010669.0

(51) Int. Cl.
*A45D 20/12* (2006.01)

(52) U.S. Cl.
CPC ..... *A45D 20/124* (2013.01)

(58) Field of Classification Search
None
See application file for complete search history.

(56) References Cited

FOREIGN PATENT DOCUMENTS

CN 205585544 U 9/2016
TW I401044 B * 7/2013

* cited by examiner

*Primary Examiner* — Jason Lau
(74) *Attorney, Agent, or Firm* — Donald J. Ersler

(57) ABSTRACT

A handheld electric hair drier comprising a main body including a primary fluid inlet, a primary fluid outlet, a fan unit, a heating element, and a fluid flow path, and a handle. The fluid flow path comprises a primary fluid flow path that extends from the main body to the primary fluid outlet along a straight line, a side fluid flow path, and a wall-defined fluid flow path. Air fluid drawn through the side fluid flow path and the wall-defined path enters the fan unit through the primary fluid flow path. The fan unit is arranged on the primary fluid flow path, and the fan unit sucks fluid into the primary fluid flow path and transmits the fluid to pass through the heating element, so that the fluid in the primary fluid flow path is heated. The hair drier can provide high-pressure jet airflow and improve the air supplementing speed.

10 Claims, 4 Drawing Sheets

HANHELD ELECTRIC HAIR DRYER

CROSS REFERENCE TO RELATED APPLICATIONS

This is a continuation-in-part application which takes priority from Chinese patent application no. 202011008242.7, filed on Sep. 23, 2020 (DAS code: 56AB), Chinese patent application no. 202011008298.2, filed on Sep. 23, 2020 (DAS code: 56AC), Chinese patent application no. 202011010666.7, filed on Sep. 23, 2020 (DAS code: 56EE) and Chinese patent application no. 202011010669.0 filed on Sep. 23, 2020 DAS code: 56AA.

FIELD OF THE INVENTION

The present invention relates to the field of handheld household appliances, in particular to a handheld electric hair dryer used for hair care and such as hair dryers and heat setting brushes.

BACKGROUND OF THE INVENTION

Based on the characteristics that the hair dryer can quickly shape and dry, it has a larger audience. The fan unit in the hair dryer can suck air from the air inlet of the hair dryer, and send the drawn air out from the air outlet that is opposite to the air inlet, so as to achieve the purpose of drying. Additionally, a hot air blower (such as a heat styling brush) is used to style hair in wet or dry conditions. A nozzle can also be connected to the air outlet of the hair dryer, through which the wind speed of the airflow can be increased and the airflow can be concentrated to achieve the purpose of modeling.

For hair dryers, the most important requirement is comfort and safety, and with current hair dryers it is generally difficult to take care of both. Specifically, for comfort, the most obvious problem is the time it takes to dry the hair. For women with larger hair volume, it often takes more than ten minutes to dry the hair. During the drying process, the user needs to keep swinging and moving the hair dryer, which is time-consuming and laborious, causing strain on the arm and affecting the user experience. If the hair should be dried quickly, there are only two ways, either increasing the temperature or increasing the airflow. Traditional hair dryers generally use the first approach, which shortens the drying time of hair by increasing the temperature. However, high temperature can easily lead to safety problems: the hair is dry and hair furcation can occur, and the scalp can be damaged under high temperature. The second way to increase the airflow can only be achieved by increasing the motor's power to drive a larger fan, but in this way, the weight and noise of the hair dryer will increase, which will further affect the user experience.

The Dyson hair dryer has been widely accepted by users. The Dyson high-speed digital motor equipped with the Dyson motor has a speed of more than 110,000 rotations per minute (most hair dryers on the market rotate at two to three thousand rounds per minute). The "Air Amplifier" technology realizes the multiplication of airflow by three times, which can make wet hair drier under the high-pressure jet airflow. It achieves "suddenly drying", which can dry quickly and reduce the damage to the hair. At the same time, due to the ultra-high frequency speed of the motor, the frequency of some noises generated is very high. Noises higher than the upper limit of hearing of ordinary human ears (20,000 Hz) cannot be heard by people, so the noise is relatively small. Even if the traditional hair dryer uses a high-speed motor, the noise problem cannot be solved. Chinese utility model CN205585544U proposes a low-noise household electric hair dryer. This utility model is equipped with a silencer component at the hair outlet to reduce noise, but the noise will still be generated and transmitted through the air inlet and housing. On the other hand, because the motor and fan of Dyson hair dryer are installed in the handle, an annular air duct is set at the connection between the handle and the hair dryer, which mainly uses the Coanda effect to discharge the air.

SUMMARY OF THE INVENTION

The main technical problem to be solved by the present invention is to provide a handheld electric hair dryer, which can provide high-pressure jet airflow while increasing the speed of supplementary airflow to reduce negative pressure to achieve airflow balance, thereby improving energy utilization efficiency. In addition, the handheld hair dryer of the present invention accelerates the heat dissipation efficiency while increasing the airflow speed per unit area.

To solve the above technical problems, one technical solution adopted by the present invention is to provide a handheld electric hair dryer, which comprises a main body 10 and a handle 11. The main body 10 comprises a primary fluid inlet 101, a primary fluid outlet 105, a fan unit 102, a heating element 103, and a fluid flow path 104. The fluid flow path 104 comprises a primary fluid flow path 1041 that extends from the primary fluid inlet 101 into the main body 10 to the primary fluid outlet 105 along a straight line, a side fluid flow path 1042, and a wall-defined fluid flow path 1043. The air fluid sucked by the side fluid flow path 1042 and the wall-defined fluid flow path 1043 enters the fan unit 102 through the primary fluid flow path 1041. The fan unit 102 is disposed on the primary fluid flow path 1041, and the fan unit 102 sucks fluid into the primary fluid flow path 1041 and transmits the fluid through the heating element 103, so that the fluid in the primary fluid flow path 1041 is heated.

Under normal circumstances, the fan unit 102 driven by the digital high-speed motor sucks in air fluid to provide high-pressure jet airflow. If the air fluid at the front of the fan unit 102 that near the primary fluid inlet 101 is insufficiently replenished, negative pressure will be formed, which will disturb the exhaust airflow at the rear of the fan unit 102 and that near the primary fluid outlet 105. On one hand, the airflow speed is weakened; on the other hand, the disturbance of the airflow and the lateral friction produce a large amount of air noise. The side fluid flow path 1042 and the wall-defined fluid flow path 1043 of the handheld electric hair dryer merge with the primary fluid flow path 1041, and the merge position is at the front end of the fan unit 102 where the fluid enters. The side fluid flow path 1042 and the wall-defined fluid flow path 1043 increase supplementing air fluid. On the one hand, the supplementary air fluid is increased to reduce the negative pressure to achieve airflow balance, and on the other hand, airflow disturbance is eliminated to reduce air noise.

In a preferred embodiment, the main body 10 further comprises a pipe 107 and an outer wall 108, the pipe 107 extends inside the outer wall 108, and the space extending between the outer surface of the pipe 107 and the inner surface of the outer wall 108 provides the wall-defined fluid flow path 1043.

In a preferred embodiment, the wall-defined fluid flow path 1043 is annular.

In a preferred embodiment, the main body 10 further comprises an air circulation chamber 106, the wall-defined fluid flow path 1043 is connected with the air circulation chamber 106 by an enlarged neck 109.

In a preferred embodiment, the primary fluid inlet 101 comprises a first opening 1011, and the first opening 1011 comprises a plurality of holes.

In a preferred embodiment, the fan unit 102 is placed in the air circulation chamber 106, and the axial direction of the fan unit 102 is parallel to the primary fluid flow path 1041.

In a preferred embodiment, the outer wall 108 close to the primary fluid outlet 105 comprises a second opening 1051, the second opening 1051 is connected to the wall-defined fluid flow path 1043, the second opening 1051 comprises a plurality of holes.

In a preferred embodiment, the side fluid flow path 1042 is perpendicular to the primary fluid flow path 1041.

The present invention further provides a handheld electric hair dryer, which comprises a main body 10 and a handle 11 wherein the main body 10 comprises a primary fluid inlet 101, a primary fluid outlet 105, a fan unit 102, a heating element 103, and a fluid flow path 104. The fluid flow path 104 comprises a primary fluid flow path 1041 that extends from the main body 10 to the primary fluid outlet 105 along a straight line, and a side fluid flow path 1042. The fan unit 102 is disposed on the primary fluid flow path 1041 wherein the fan unit 102 generates an air flow into the primary fluid flow path 1041 and transmits the air flow through the heating element 103, so that the air flow in the primary fluid flow path 1041 is heated. At least a part of the air flow received by the side fluid flow path 1042 enters the fan unit 102 through the primary fluid flow path 1041, and the side fluid flow path 1042 comprises at least two bends 10421; part of the side fluid flow path 1042 comprises a third opening 1061 that comprises a plurality of openings that extend at least partially around an outer wall 108 of the main body 10.

In a preferred embodiment, the side fluid flow path 1042 is perpendicular to the primary fluid flow path 1041. This means that the main direction of travel of the air flow along the side fluid flow path 1042 notwithstanding the bends 10421 is from a first point outside of the main body (10) to a second point located on the primary fluid flow path 1041, the two points defining a direction perpendicular to the primary fluid flow path 1041.

In a preferred embodiment, the two bends 10421 are nearly right angles.

In a preferred embodiment, the two bends 10421 are symmetrically arranged on the side fluid flow path 1042.

DESCRIPTION OF THE DRAWINGS

The present invention and its advantages as described according to the drawings are given as exemplary embodiments and detailed description of the specific embodiments shown in the attached drawings shall not be interpreted as limiting. In the drawings.

DETAILED DESCRIPTION OF ILLUSTRATED EMBODIMENTS

Figure 1:
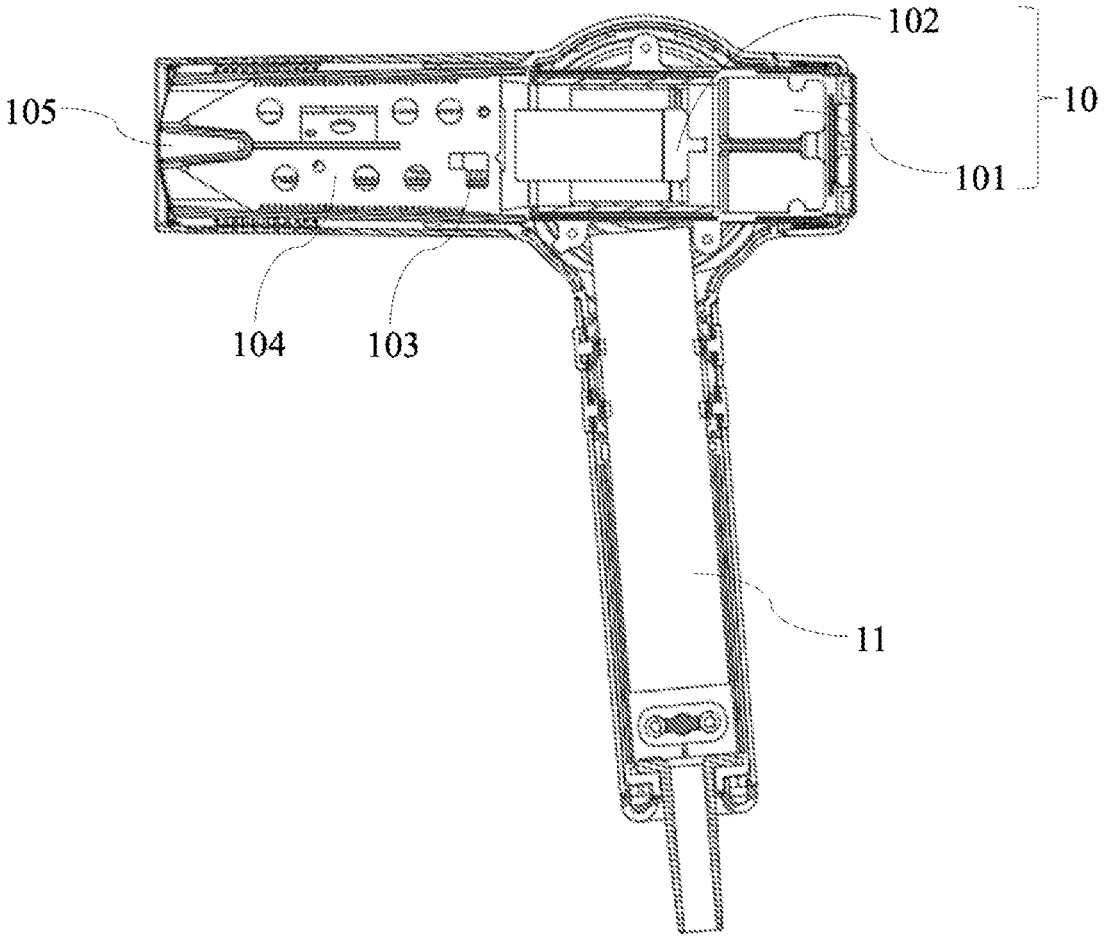
FIG. 1 is a cross-sectional structural view of the handheld electric hair dryer according to Embodiment 1 of the present invention.

The disclosure may be more completely understood in consideration of the following detailed description of various embodiments of the disclosure in connection with the accompanying drawings. The following description is based on the illustrated specific embodiments of the present invention, and should not be regarded as limiting other specific embodiments of the present invention that are not described in detail herein.

The word "embodiment" used in this specification means serving as an example, example, or illustration. In addition, the article "a" used in this specification and appended claims can generally be construed as meaning "one or more" unless specified otherwise or clearly directed to the singular form from the context.

In the description of the present invention, it should be understood that the terms "center", "longitudinal", "transverse", "length", "width", "thickness", "upper", "lower", "front", ""Back", "Left", "Right", "Vertical", "Horizontal", "Top", "Bottom", "Inner", "Outer", "Clockwise", "Counterclockwise" and other directions are positional relationships based on the position or positional relationship shown in the drawings, and is only for the convenience of describing the present invention and simplifying the description, and does not indicate or imply that the pointed device or element must have a specific orientation, be constructed and operated in a specific orientation, Therefore, it cannot be understood as a limitation to the present invention.

In the description of the present invention, it should be noted that the terms "set" and "connected" should be understood in a broad sense unless otherwise clearly specified and limited. For example, they can be fixed or detachable. Connected or integrally connected; it can be mechanically connected, or it can be electrically connected or can communicate with each other; it can be directly connected, or indirectly connected through an intermediate medium, it can be the internal communication of two components or the interaction of two components in relationship. For those of ordinary skill in the art, the specific meaning of the above-mentioned terms in the present invention can be understood according to specific circumstances.

In addition, unless expressly stipulated and defined otherwise, the "above" or "below" of the first feature of the second feature may include the first and second features in direct contact, or the first and second features are not in direct contact but through the contact of other features between them. Moreover, "above" the second feature of the first feature includes the first feature being directly above and obliquely above the second feature, or indicating that the first feature is higher in level than the second feature. The "below" the first feature of the second feature includes the first feature directly below and obliquely below the second feature, or that the level of the first feature is lower than the second feature.

The following disclosure provides many different embodiments or examples for realizing different structures of the present invention. In order to simplify the disclosure of the present invention, the components and settings of specific examples are described below. Of course, they are only examples, and the purpose is not to limit the present invention. In addition, the present invention may repeat reference numerals and/or reference letters in different examples, and this repetition is for the purpose of simplification and clarity, and does not indicate the relationship between the various embodiments and/or settings discussed. In addition, the present invention provides examples of various specific processes and materials, but those of ordinary skill in the art may be aware of the application of other processes and/or the use of other materials.

Example 1

Figure 2:
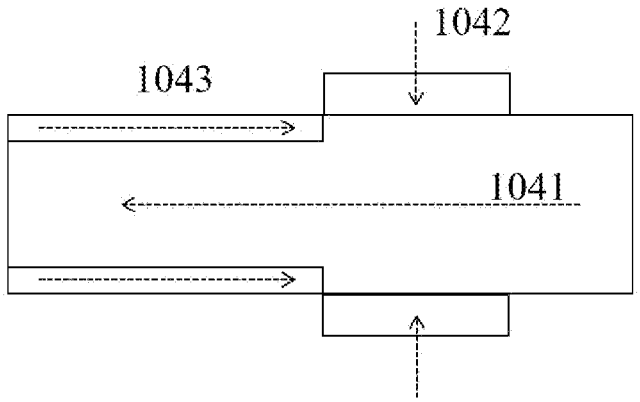
FIG. 2 is a schematic diagram of a fluid flow path 104 according to Embodiment 1 of the present invention.

First, with reference to FIGS. 1-4, the handheld hair dryer according to the first embodiment of the present invention will be described. One technical solution adopted by the present invention is to provide a handheld hair dryer, as shown in FIG. 1, which comprises a main body 10 and a handle 11. The main body 10 comprises a primary fluid inlet 101, a fan unit 102, a heating element 103, a fluid flow path 104, and the primary fluid outlet 105. As shown in FIG. 2 (the direction of the arrow indicates the direction of fluid flow), the fluid flow path 104 comprises a primary fluid flow path 1041 that extends linearly from the primary fluid inlet 101 into the main body 10 to the primary fluid outlet 105. The side fluid flow path 1042 and the wall-defined fluid flow path 1043 are also shown in FIG. 2. The fluid sucked by the lateral path 1042 and the wall-defined fluid flow path 1043 enters the fan unit 102 through the primary fluid flow path 1041. The fan unit 102 is disposed on the primary fluid flow path 1041, and the fan unit 102 sucks fluid into the primary fluid flow path 1041 and transmits the fluid through the heating element 103, so that the fluid in the primary fluid flow path 1041 is heated.

Under normal circumstances, the fan unit 102 driven by the digital high-speed motor sucks in air fluid to provide high-pressure jet airflow. If the air fluid at the front of the fan unit 102 that near the primary fluid inlet 101 is insufficiently replenished, negative pressure will be formed, which will disturb the exhaust airflow at the rear of the fan unit 102 near the primary fluid outlet 105. On one hand, the airflow speed is weakened; on the other hand, the disturbance of the airflow and the lateral friction produce a large amount of air noise. The side fluid flow path 1042 and the wall-defined fluid flow path 1043 of the handheld electric hair dryer merge with the primary fluid flow path 1041, and the merge position is at the front end of the fan unit 102 where the fluid enters. The side fluid flow path 1042 and the wall-defined fluid flow path 1043 increase supplementing air fluid. On the one hand, the supplementary air fluid is increased to reduce the negative pressure to achieve airflow balance, and on the other hand, airflow disturbance is eliminated to reduce air noise.

Figure 3:
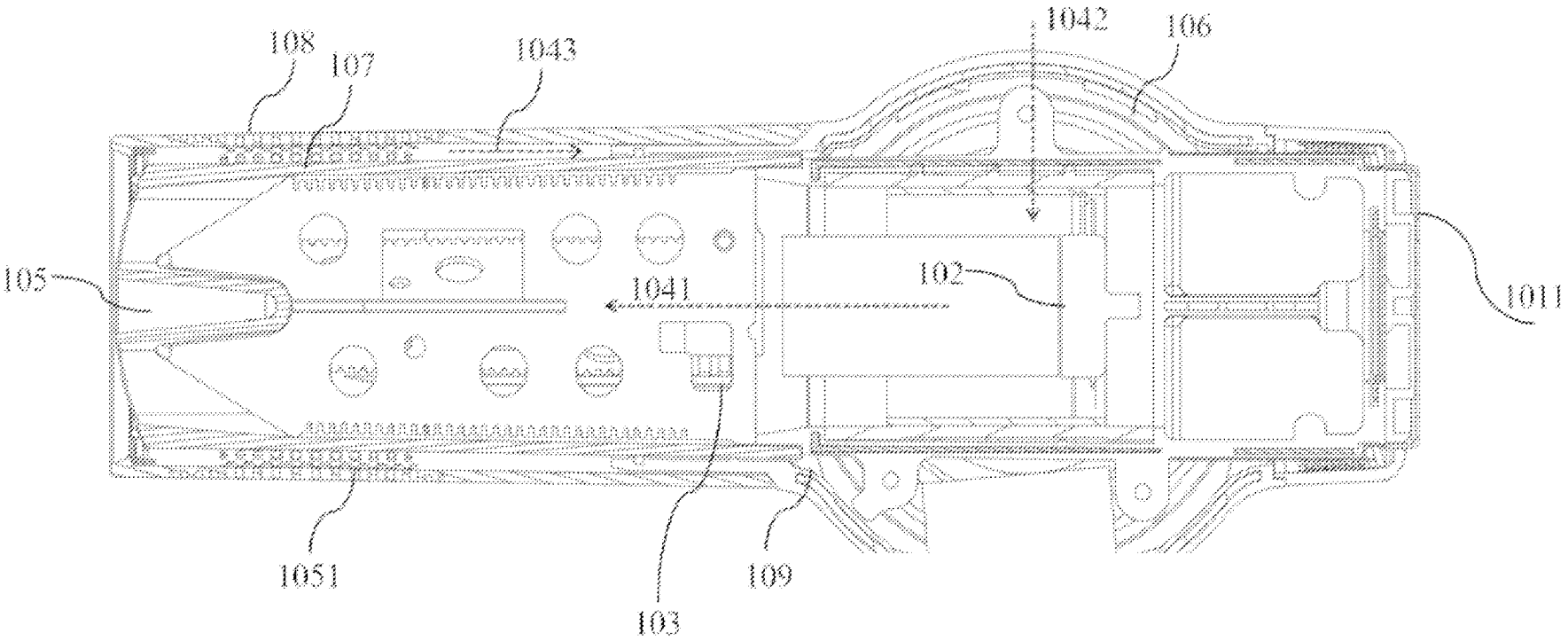
FIG. 3 is a cross-sectional structural view of the main body 10 of the handheld hair dryer according to Embodiment 1 of the present invention.

As shown in FIG. 3, the main body 10 further comprises a pipe 107 and an outer wall 108, the pipe 107 extends inside the outer wall 108, and the space extending between the outer surface of the pipe 107 and the inner surface of the outer wall 108 provides the wall-defined fluid flow path 1043.

The wall-defined fluid flow path 1043 is annular.

As shown in FIG. 3, the main body 10 further comprises an air circulation chamber 106, the wall-defined fluid flow path 1043 is connected with the air circulation chamber 106 by an enlarged neck 109. The pipe 107 is connected to the air circulation chamber 106 through the enlarged neck 109, and the air circulation chamber 106 forms a low pressure area and provokes the Coanda effect that the supplementary air fluid provided by the wall-defined fluid flow path 1043 is increased to reduce the negative pressure to achieve airflow balance.

Figure 4:
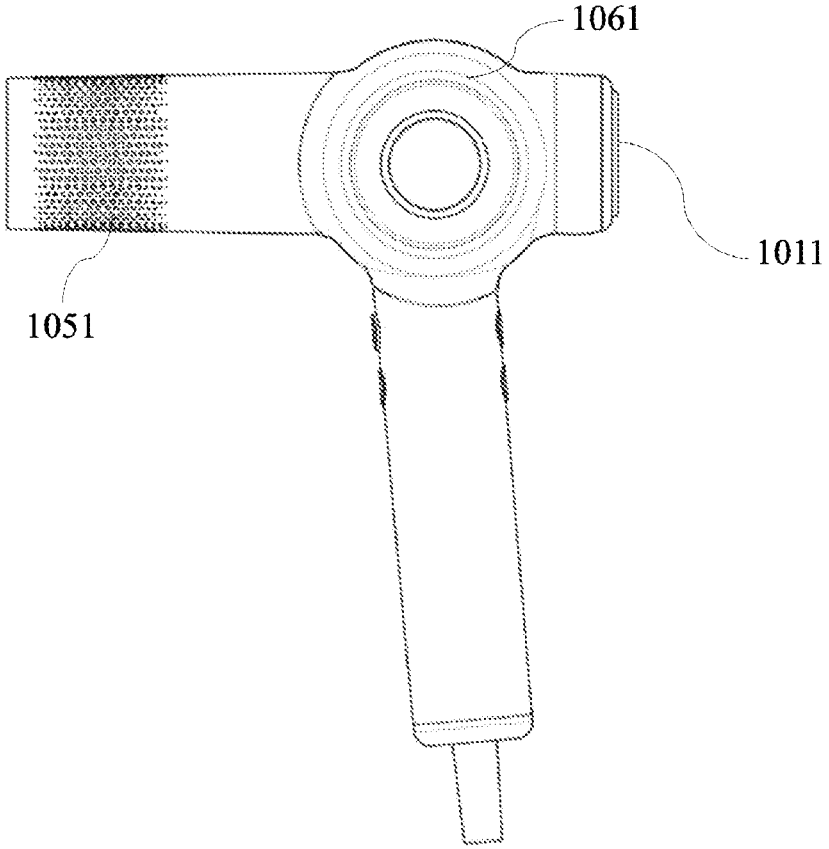
FIG. 4 is a side view of the handheld hair dryer according to Embodiment 1 of the present invention.

As shown in FIG. 4, the primary fluid inlet 101 comprises a first opening 1011, and the first opening 1011 comprises a plurality of holes.

As shown in FIG. 3, the fan unit 102 is placed in the air circulation chamber 106, and the axial direction of the fan unit 102 is parallel to the primary fluid flow path 1041.

The outer wall 108 close to the primary fluid outlet 105 comprises a second opening 1051, the second opening 1051 is connected to the wall-defined fluid flow path 1043, the second opening 1051 comprises a plurality of holes.

The side fluid flow path 1042 is perpendicular to the primary fluid flow path 1041.

The handheld hair dryer of this embodiment can provide high-pressure jet airflow while increasing the speed of supplemental air to reduce negative pressure to achieve airflow balance, thereby improving energy utilization efficiency. In addition, the handheld hair dryer of this embodiment accelerates the heat dissipation efficiency when the air outlet 105 speed per unit area is increased.

Example 2

Figure 5:
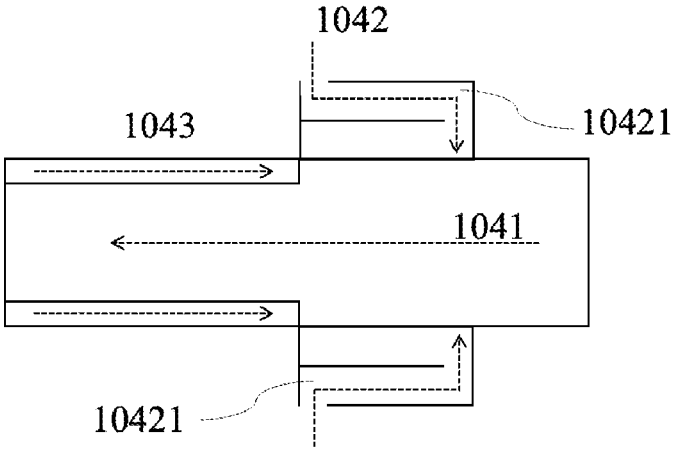
FIG. 5 is a schematic diagram of a fluid flow path 104 of Embodiment 2 of the present invention.

Please refer to FIG. 5, which is a schematic diagram of a fluid flow path 104 of Embodiment 2 of the present invention. Only the differences between Embodiment 2 and Embodiment 1 will be described below, and the similarities will not be repeated here.

As shown in FIG. 5, the side fluid flow path 1042 comprises two bends 10421. The two bends 10421 are nearly right angles. The two bends 10421 are symmetrically disposed on the side fluid flow path 1042.

Figure 6:
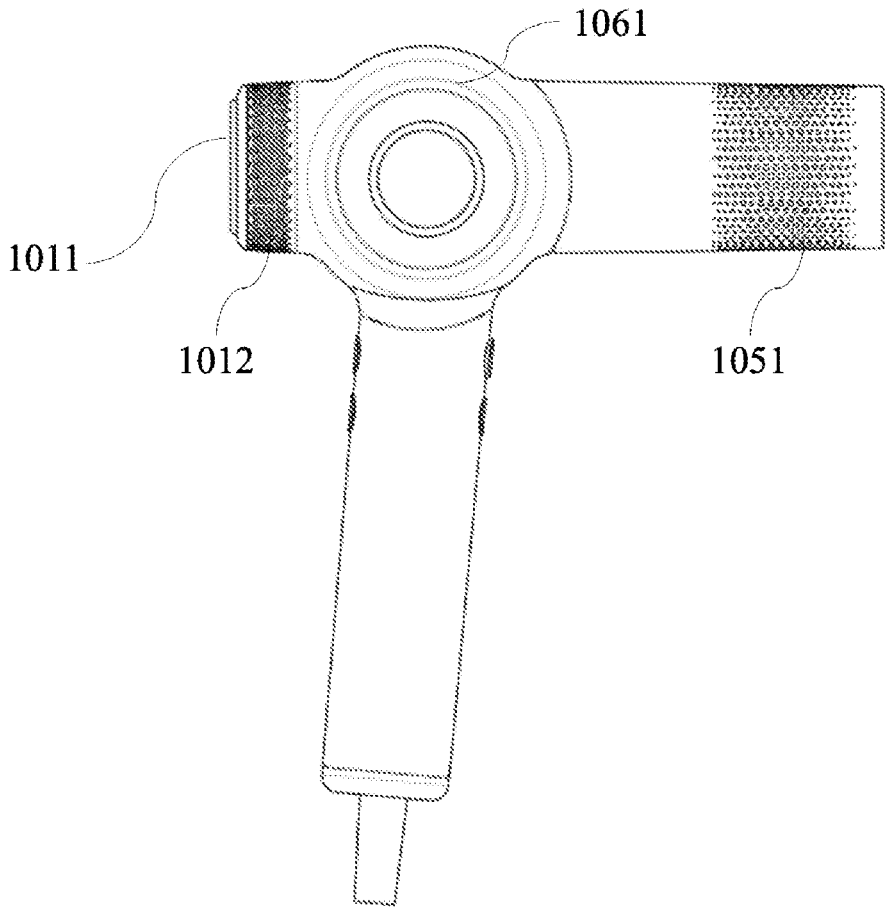
FIG. 6 is a side view of the handheld hair dryer according to Embodiment 2 of the present invention.

The setting of the two bends 10421 makes the cavity between the two bends 10421 have a natural frequency. When sound waves containing various frequency components enter the short pipe 107 connected to a third opening 1061 (as shown in FIG. 6), only sound waves of certain frequencies near the natural frequencies of the multiple holes of the third opening 1061 can pass through to reach the outlet of the third opening 1061. While sound waves of some frequencies cannot pass through the third opening 1061 and can only be reflected back and forth in the cavity. The structure of two bends 10421 with a filtering function for sound waves constitutes an acoustic filter, which belongs to the principle of resistance silencing, which reduces the noise generated by the side fluid flow path 1042. The side fluid flow path 1042 increases the supplement of the airflow. On the one hand, the supplementary airflow is increased to reduce the negative pressure to achieve airflow balance, and on the other hand, the airflow disturbance on the primary fluid outlet 105 is eliminated and the air noise is reduced.

As shown in FIG. 6, the outer wall 108 of the main body 10 close to the primary fluid inlet 101 comprises a fourth opening 1012, the fourth opening 1012 comprises a plurality of holes, and the plurality of holes at least partially extends around the main body 10. The fourth opening 1012 connects to the air circulation chamber 106.

Although the present invention has been described above with reference to some embodiments, without departing from the scope of the present invention, various modifications can be made to it and the components therein can be replaced with equivalents. In particular, as long as there is no structural conflict, the various features in the various embodiments disclosed in the present invention can be combined with each other in any manner. Therefore, the present invention is not limited to the specific embodiments disclosed in the text, but includes all technical solutions falling within the scope of the claims.

We claim:

1. A handheld electric hair dryer, comprising:

a main body and a handle wherein the main body comprises a primary fluid inlet, a primary fluid outlet, a fan unit, a heating element, and a fluid flow path characterized in that the fluid flow path comprises:

a primary fluid flow path that extends from the primary fluid inlet into the main body to the primary fluid outlet along a straight line;

a side fluid flow path comprises at least two bends and a third opening that comprises a plurality of holes that extend at least partially around an outer wall of the main body; and a wall-defined fluid flow path, wherein the side fluid flow path and the wall-defined fluid flow path meet the primary fluid flow path before entering the fan unit, the fan unit is disposed on the primary fluid flow path wherein the fan unit is adapted to suck fluid into the primary fluid flow path and to transmit the fluid through the heating element so that the fluid in the primary fluid flow path is heated.

2. The handheld electric hair dryer according to claim 1, wherein the main body further comprises an air circulation chamber, the wall-defined fluid flow path is connected with the air circulation chamber by an enlarged neck.

3. The handheld hair dryer according to claim 2, wherein the primary fluid inlet comprises a first opening, and the first opening comprises a plurality of holes.

4. The handheld hair dryer according to claim 2, wherein the fan unit is placed in the air circulation chamber, and the axial direction of the fan unit is parallel to the primary fluid flow path.

5. The handheld hair dryer according to claim 1, wherein the outer wall close to the primary fluid outlet comprises a second opening, the second opening is connected to the wall-defined fluid flow path, the second opening comprises a plurality of holes.

6. The handheld hair dryer according to claim 1, wherein the side fluid flow path is perpendicular to the primary fluid flow path.

7. The handheld electric hair dryer according to claim 6, wherein the two bends are approximately right angles.

8. The handheld electric hair dryer according to claim 6, wherein the two bends are symmetrically disposed on the side fluid flow path.

9. A handheld electric hair dryer, comprising:

a main body and a handle wherein the main body comprises a primary fluid inlet, a primary fluid outlet, a fan unit, a heating element, and a fluid flow path characterized in that the fluid flow path comprises:

a primary fluid flow path that extends from the primary fluid inlet into the main body to the primary fluid outlet along a straight line, wherein the main body further comprises a pipe and an outer wall, the pipe extends within the outer wall, and the space extending between the outer surface of the pipe and the inner surface of the outer wall provides the wall-defined fluid flow path;

a side fluid flow path; and a wall-defined fluid flow path, wherein the side fluid flow path and the wall-defined fluid flow path meet the primary fluid flow path before entering the fan unit, the fan unit is disposed on the primary fluid flow path wherein the fan unit is adapted to suck fluid into the primary fluid flow path and to transmit the fluid through the heating element so that the fluid in the primary fluid flow path is heated.

10. A handheld electric hair dryer, comprising:

a main body and a handle wherein the main body comprises a primary fluid inlet, a primary fluid outlet, a fan unit, a heating element, and a fluid flow path characterized in that the fluid flow path comprises:

a primary fluid flow path that extends from the primary fluid inlet into the main body to the primary fluid outlet along a straight line, wherein the main body further comprises a pipe and an outer wall, the pipe extends within the outer wall, and the space extending between the outer surface of the pipe and the inner surface of the outer wall provides the wall-defined fluid flow path, wherein the wall-defined fluid flow path is annular;

a side fluid flow path; and a wall-defined fluid flow path, wherein the side fluid flow path and the wall-defined fluid flow path meet the primary fluid flow path before entering the fan unit, the fan unit is disposed on the primary fluid flow path wherein the fan unit is adapted to suck fluid into the primary fluid flow path and to transmit the fluid through the heating element so that the fluid in the primary fluid flow path is heated.

* * * * *